United States Patent [19]

Rijnders

[11] 4,297,822

[45] Nov. 3, 1981

[54] PANELLED CEILING

[75] Inventor: Willem Rijnders, Alblasserdam, Netherlands

[73] Assignee: Hunter Douglas International, N.V., Curacao, Netherlands Antilles

[21] Appl. No.: 51,504

[22] Filed: Jun. 25, 1979

[30] Foreign Application Priority Data

Jul. 15, 1978 [DE] Fed. Rep. of Germany ..... 2831203

[51] Int. Cl.[3] ..... E04F 13/08

[52] U.S. Cl. ..... 52/484; 52/486; 52/489

[58] Field of Search ..... 52/145, 484, 487, 486, 52/489, 765, 509, 511, 512, 770, 772, 774, 775, 354, 355, 357, 359, 360, 362

[56] References Cited

U.S. PATENT DOCUMENTS

| | | | |
|---|---|---|---|
| 1,095,396 | 5/1914 | Herbert | 52/359 |
| 1,738,469 | 12/1929 | Weiss | 52/509 |
| 2,005,030 | 6/1935 | Geisinger | 52/774 |
| 2,044,216 | 6/1936 | Llages | 52/774 |
| 2,151,221 | 3/1939 | Meeker | 52/512 |
| 2,271,924 | 2/1942 | Nielsen | 52/512 |
| 2,312,673 | 3/1943 | Rizzolo | 52/512 |
| 2,710,175 | 6/1955 | Jorn | 52/484 |
| 2,930,665 | 3/1960 | Badai | 52/145 |
| 3,022,869 | 2/1962 | Radek | 52/489 |

FOREIGN PATENT DOCUMENTS

| | | | |
|---|---|---|---|
| 1098613 | 1/1968 | United Kingdom | 52/489 |

*Primary Examiner*—Price C. Faw, Jr.
*Assistant Examiner*—Henry E. Raduazo
*Attorney, Agent, or Firm*—Pennie & Edmonds

[57] ABSTRACT

A suspended ceiling is disclosed having a plurality of spaced parallel elongated supports (14) suspended from permanent overhead structure. A plurality of panels (12) provide the ceiling face and are supported from the elongated supports (14) by means of holders (10). The holders (10) themselves are secured to the supports (14) by bent over lugs (20) passing through openings (40) in the support (14). Opposite edges of each panel (12) have support flanges (46,50) complementary to each other with one flange (46) being bent inwardly and downwardly (48) with respect to the panel (12) and the other flange (50) having a support portion (52) extending outwardly of the panel. The holders (10) have hook-like elements (26) which engage the inwardly and downwardly bent flanges (48) with the outwardly extending flanges (52) resting on top thereof. A pair of spaced downwardly extending projections (30) are provided which serve to engage in the space (32) therebetween upwardly bent side flanges (44) of adjacent panels (12).

7 Claims, 6 Drawing Figures

PANELLED CEILING

FIELD OF THE INVENTION

This invention relates to a panelled ceiling of the type in which a plurality of elongated ceiling supports are arranged in spaced parallel relationship and a plurality of rectangular, usually elongated, ceiling panels are secured thereto by means of holding elements or holders. In one embodiment of such ceilings, each of the panels has its peripheral edges bent upwards towards the supports with two opposite up-turned edges having flanges, one of which is bent inward of the panel and the other of which is bent outwardly thereof.

While, commonly, these panels are relatively long with respect to their width, they can also be quite wide and even have a square shape suggestive of coffers.

In many previous such systems for ceilings, the holding elements or holders are secured to the support or the panels, or both, by means of separate attaching elements, such as rivets, screws or bolts. In other such ceilings, the holders are designed to eliminate the need for such separate fastening elements but, in these instances, the holders are frequently complex in shape or include springable elements which make the holders difficult and time-consuming to install; one such holder is shown in U.S. Pat. No. 3,640,033.

BRIEF SUMMARY OF THE INVENTION

Accordingly, it is one object of the invention to provide a simple holder which may be readily formed on conventional machinery and which may be assembled to the support and to the panel in a convenient manner without tools. To this end, a holder is provided that may be formed out of sheet metal by cutting, punching out or bending, thus making the manufacture thereof simple and very inexpensive.

The holder has a generally rectangular base with a pair of up-struck locking tabs which may pass through suitable openings in the ceiling support and then be bent over to secure the holder to the support. The bending over of these tabs may be accomplished with the fingers. From the base, at least one downwardly protruding flange having a holder projection or hook is provided, although preferably two spaced parallel flanges each having such a hook is used. Also extending downwardly from the base are a pair of spaced prongs. Each of the panels has a pair of support flanges along two opposite edges thereof, one member of the pair being bent inwardly of the panel and the other outwardly. When a plurality of panels are assembled, the inwardly-turned flange of one panel is first engaged over the hooks of the holder and then the outwardly extending flange of a second panel is engaged over the inwardly-turned flange of the adjacent panel, whereby the hooks support both flanges. Each panel has its other marginal edges bent upwardly and, when in place, one marginal edge of each of two adjacent panels is engaged with the prongs of the holder by insertion in the space between the prongs. In the first preferred embodiment of the invention, the downwardly extending flanges having the terminal hooks are positioned along opposite side edges of the base of the hanger while the downwardly extending prongs extend downwardly from the base of the hanger along an edge thereof running transverse to the downwardly projecting flanges.

In one modified embodiment, the downwardly extending flanges having the hooks are one integral-flange with the hooks spaced apart at the edge thereof and with the downwardly extending prongs extending downwardly from the same integral flange from a position between the hooks.

The holders may be used to support as many as four adjacent panels where one corner of each is positioned close to a corner of each of the other three panels. The termini of the prongs are curved upwardly to facilitate the assembly or removal of ceiling panels. This is of particular advantage whenever mats of insulating material or the like are placed on the upper sides of the panels; in which event, the prongs have their rounded termini bearing against the mats.

The space between each pair of prongs is chosen to correspond to the desired distance between adjacent ceiling panels, i.e. the distance between the upwardly bent marginal edges of two adjacent ceiling panels.

While normally the holders are used without any attachments, they may be further attached to either one or both of the ceiling supports and the panel flanges, particularly when the panels are used outdoors where they are subject to being impinged upon by wind, which may cause lifting or rattling of the panels. Such further securement being accomplished by rivets, screws, bolts, or the like. Still further, spacers may be located as indicated hereinafter to further prevent rattling or inadvertent dislodgement.

DETAILED DESCRIPTION OF THE INVENTION

Figure 3:
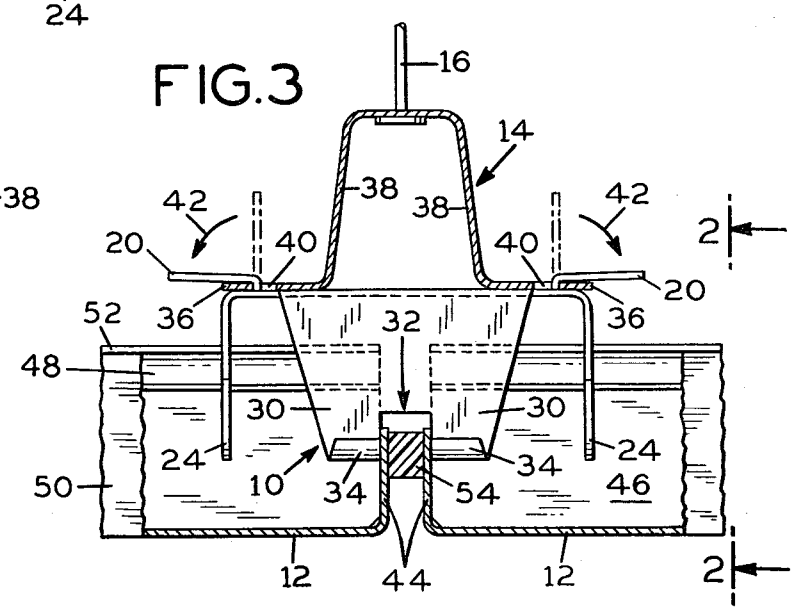
FIG. 3 is a cross-sectional view taken at right angles to FIG. 2, generally along the line 3—3 of FIG. 2.
Figure 2:
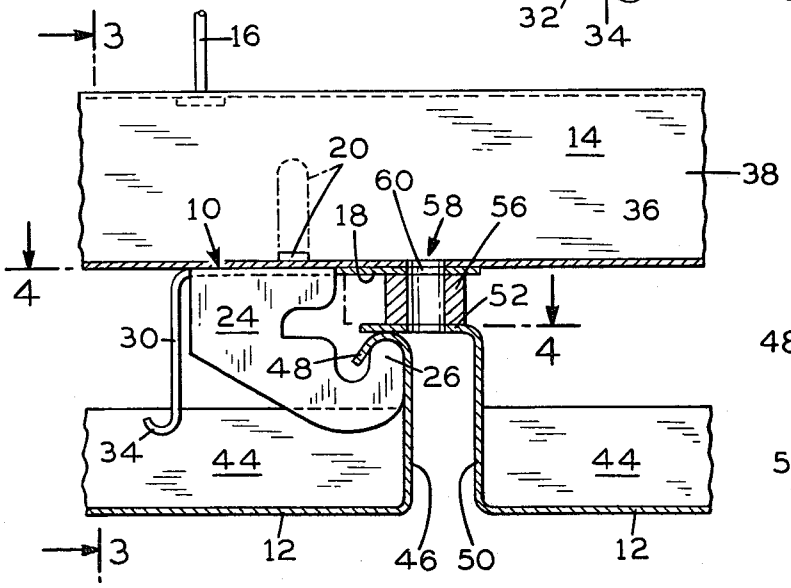
FIG. 2 shows a cross-sectional view through a suspended ceiling, generally along the line 2—2 of FIG. 3.

As shown in FIGS. 2 and 3, the suspended ceiling includes a panel holder 10 which secures a plurality of panels 12 to the overhead support 14 which, as shown in FIG. 3, has a generally hat-shape in cross-section. The support 14 is supported from a permanent overhead structure, such as a concrete ceiling-floor between floors of a building by any known means, including the wire 16 shown.

Figure 1:
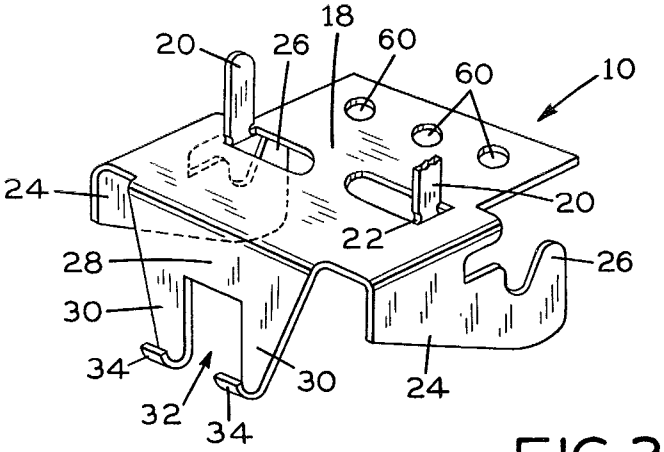
FIG. 1 shows an illustrative embodiment of a holder in accordance with the present invention in perspective view.

As shown in FIG. 1, the holder 10 includes a generally rectangular base 18. Punched out and bent upwardly from the base 18 are a pair of securing lugs 20 which, adjacent their juncture with the base 18, have been slightly weakened by the fact that their cross-section is reduced at 22. This permits of ready bending of the same, as later described. Depending downwardly from each side of the base are a pair of flanges 24 which terminate in hooks 26. Also bent downwardly from the base 18 is a third flange 28 from which two projections extend still further downwardly in spaced relationship thereby defining an opening 32 between them. Each of the projections 30 terminates in a rounded portion 34.

Figure 4:
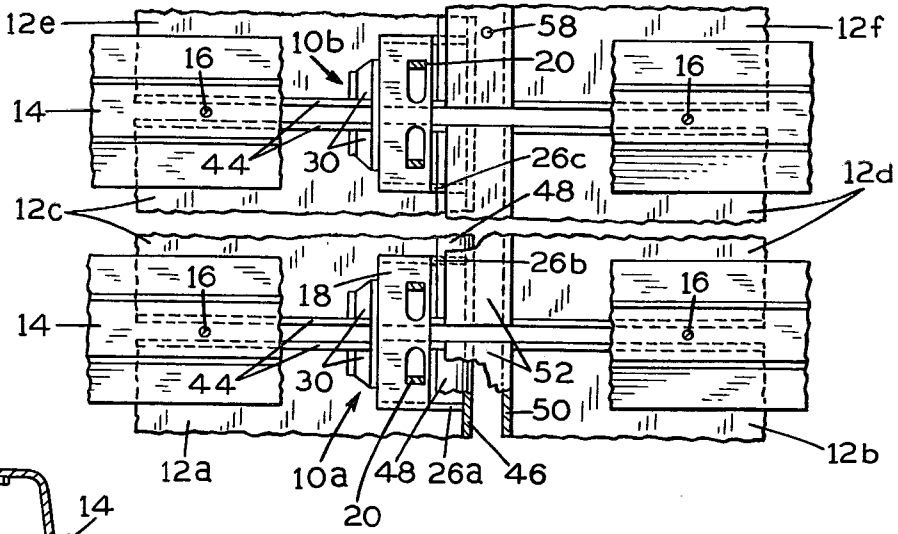
FIG. 4 is a view taken generally along the line 4—4 of FIG. 2, which is a top planar view (without the ceiling support) and showing how a series of panels are secured by the holders.

As shown in FIGS. 2, 3 and 4, the supports 10 are elongated and arranged in spaced parallel relationship to each other. Each support 14 includes flanges 36 throughout the length thereof. Flanges 36 extend outwardly in opposite directions from each of the side walls 38 of the support 14. At selected intervals along each of the flanges 36, there are a plurality of slots or openings 40 for receipt of the lugs 20. It will be appreciated that the openings 40 are in pairs with opening in one flange 36 having a mating opening 40 in the other flange 36. As shown, the holder 10 is first applied to the support 14 by inserting the lugs 20 through the openings 40, at which time they are in dashed line positions shown in FIGS. 2 and 3. Thereafter, they are simply bent downwardly in the direction indicated by the arrows 42 until they assume the solid line position shown. In this position, the lugs 20 securely lock the holder 10 to the support 14. This bending over may usually be accomplished by using the fingers, although it may be aided with the use of a hammer or the like.

The ceiling panels 12 to be suspended from the holders 10, as illustrated herein, are generally elongated with two opposite relatively short edges and two opposite relatively longer edges. However, it will be understood that the relative dimensions of the panel are no way effected by or effect the holder or the features of this invention. The panels 12 can just as well be square. As shown in FIG. 3, each of the longer edges of the panels 12 has an upwardly bent flange 44, which flanges 44 are received in the opening 32 between the projections 30 of the holder 10.

One of the shorter edges of each panel 12 has an upwardly bent flange 46 which terminates in a downwardly curved hook-shape 48, which is engaged over the hook 26 on the flange 24 of the support 10. The opposite short edge of each of the panels 12 (i.e. opposite to the edge having flange 46) has an upwardly bent flange 50 terminating in a laterally extending flange 52 which, in assembled position, rests upon the hook portion 48 of a flange 46 for the next adjacent panel 12 whereby the laterally extending flange 52 is also supported from the hook 26. It will be appreciated that there will be a holder 10 positioned, as shown in FIG. 2, wherever the short edge flange 46 of one panel 12 faces a short edge flange 50 of an adjacent panel 12 as well as a holder 10 at the ends of the last panels in each row adjacent the wall.

As shown in FIG. 4, the elongated supports 14 are arranged in spaced parallel relationship but, in this figure, they are broken away in order to reveal the relationship of the holders 10 to the panels 12. In FIG. 4, portions of six panels 12 are shown, as indicated by the reference numerals 12*a*, 12*b*, 12*c*, 12*d*, 12*e* and 12*f*. There are also two holders 10 shown being separately marked 10*a* and 10*b*. The support 10*a* is so positioned that its projections 30 straddle the flanges 44 of the two adjacent panels 12*a*, 12*c*. The panel 12*a* has the hooked portion 48 of its upwardly extending flange 46 engaged over the hook 26*a* of the holder 10*a*. The flange 52 of the panel 12*b* is also supported by the hook 26*a* since it rests upon the hook terminus 48 of the flange 46 of the panel 12*a*. At its other end, the holder 10*a* has its hook 26*b* engaged beneath the hook terminus 48 of the flange 46 for the panel 12*c* and the flange 52 from the panel 12*d* rests thereupon. At their other ends, the flange 48 for the panel 12*c* and the flange 52 for the panel 12*d* are engaged with the hook 26*c* of the holder 10*b*. Thus, it will be seen that each holder 10 supports an adjacent corner of each of four panels, with the holder 10*a* supporting the adjacent corners of the panels 12*a*, 12*b*, 12*c* and 12*d* and the holder 10*b*, in like manner, supporting the adjacent corners of the panels 12*c*, 12*d*, 12*e* and 12*f*.

The flange 28 with its projections 30 serve on the one hand to support and to secure panels or mats of insulating material or the like which may, if desired, be placed within the panels 12. Also, the rounded ends 34 help in guiding the assembly or disassembly of the panels 12 with their flanges 44 positioned within space 32 between the projections 30. Also, the projections 30 serve to maintain the alignment of the flanges 44. If desired, a sealing material or an elastic material 54 may be inserted, as shown in FIG. 3, between the adjacent flanges 44 of adjacent panels 12 in order to cause them to bear firmly against the projections 30 and to avoid rattling.

FIG. 2 also shows a spacer element 56 positioned between the flange 52 and the base 18 of the holder 10. Still further, if desired, the spacer 56 may be held in place by a suitable connecter passing through aligned openings in the flange 36 of carrier 14, base 18 of the holder 10, the spacer 56, and an opening in the flange 52. Such aligned openings are generally indicated at 58 in FIG. 2. The opening in the base 18 is indicated at 60 in FIG. 1, there being three shown, any one of which may be used for the rivet, screw, bolt or other connecter passing through the aligned openings 58. The aligned openings 58, including the openings 60 in the holder, may be provided when the various parts are manufactured or may be provided on the site by drilling the same at that time. In most installations, particularly indoor installations, the spacer 56 is not necessary, although occasionally in large rooms the air currents may be such as to cause rattling which can be eliminated by the use of the spacer 56 with or without a connecter passing therethrough. Such rattling may also sometimes be caused in small air-tight rooms upon the sudden opening or closing of a door. When installed out-of-doors, such as on the ceiling of entry ways, overhangs, and the like, it is generally preferred to use some sort of spacer 56 with a connector since such a ceiling is subject to strong gusts of wind.

Figure 5:
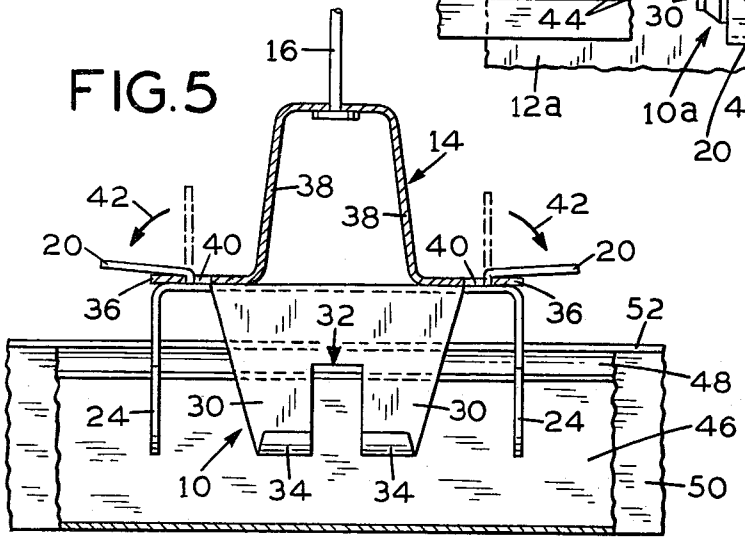
FIG. 5 is a view similar to FIG. 3 showing the use of the holder intermediate the ends of the panel support flanges.

In FIG. 5, the holder 10 is shown with both of its projections 26 engaged beneath the same bent-over terminus 48 of the same flange 46 and with a single flange 52 of an adjacent panel resting thereupon. That is to say, that this figure shows the holder 10 positioned intermediate the ends of the short edges of a pair of adjacent panels 12. Such positioning will be necessary when the short edge of the panel is relatively long with large panels, in which case there may be a number of holders 10 for each panel 12, for example, intermediate the holders 10*a* and 10*b* of the panel 12*c*.

MODIFIED EMBODIMENT

Figure 6:
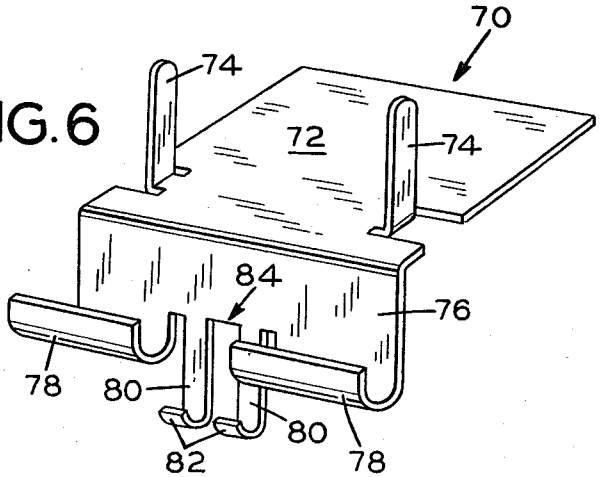
FIG. 6 is a perspective view of a second embodiment of the holder element.

FIG. 6 shows a modified embodiment 70 of the holder 10 having a rectangular base 72 with cut-out and upwardly bent lugs 74 similar to the lugs 20 of FIG. 1. In this embodiment, a downwardly bent flange 76 has at its opposite ends upwardly curved hook-like members 78 which serve essentially the same purpose as hooks 26 of the holder 10. Intermediate the hooks 78 and also extending from the flange 76 are a pair of projections 80, each terminating in an upwardly curved rounded portion 82. The projections 80 and the space 84 between them serve essentially the same functions as those served by the projections 30 and the space 32 in the first embodiment of the holder 10 shown in FIG. 1.

I claim:

1. In a suspended ceiling having a plurality of elongated supports arranged in spaced parallel relationship with each other, a plurality of holders secured to said supports, a plurality of panels, each of said panels having a pair of upwardly extending flanges at a pair of opposite edges thereof, one of said upwardly extending flanges terminating in a support portion bent inwardly and downwardly with respect to the panel, the other of said upwardly extending flanges terminating in a support portion extending outwardly of said panel, the improvement comprising at least one of said holders having a base, means extending downwardly from said base and having at least one panel support element, the inwardly and downwardly bent support portion of a first panel engaging a panel support element, the outwardly extending support portion of an adjacent panel engaging the inwardly and downwardly bent support portion of said first panel, a pair of spaced projections extending downwardly from said base, each panel having a second pair of upwardly extending flanges along its other opposite edges, and one of said second flanges from each of two adjacent panels extending into the space between said two projections.

2. The suspended ceiling according to claim 1, in which said means extending downwardly from said base has a pair of spaced panel support elements, each of said elements having a generally hook-like shape facing in a first direction, said pair of spaced projections terminating in rounded ends facing in a second direction opposite to said first direction.

3. The suspended ceiling of claim 1, in which said means extending downwardly from said base has a pair of spaced panel support elements, each of said elements having a generally hook-like shape facing in a first direction, said pair of spaced projections terminating in rounded ends also facing in said first direction.

4. The suspended ceiling of claim 1, in which said means extending downwardly from said base comprises a pair of lateral flanges extending downwardly from two opposite sides of said base, the free ends of said lateral flanges each having a hook-like support element, a third flange extending downwardly from a side of said base extending transverse to said pair of lateral flanges, and said pair of spaced downwardly extending projections extending downwardly from said third flange.

5. The suspended ceiling according to claim 1, in which said means extending downwardly from said base includes a downwardly extending base flange, a pair of spaced hook-like support elements on the free edge of said base flange, and said pair of spaced downwardly extending projections extending downwardly from said base flange from between said spaced hook-like elements.

6. The suspended ceiling of any one of the preceding claims, in which said second flanges extending into the space between said two projections are themselves spaced apart, and the space between said two projections predetermines the distance between the second flanges inserted therebetween.

7. The suspended ceiling of claim 6, in which a pair of bendable lugs extend from said base, openings in said elongated supports through which said lugs pass, and said lugs being bent over to secure the holder to the support.

* * * * *